US008689462B2

(12) United States Patent
Bae et al.

(10) Patent No.: US 8,689,462 B2
(45) Date of Patent: Apr. 8, 2014

(54) STEAM LAUNDRY DRYER

(75) Inventors: Sang Hun Bae, Changwon-si (KR); Dong Geun Lee, Changwon-si (KR); Seon Il Heo, Changwon-si (KR); Yeon Sik Choi, Changwon-si (KR); Ju Han Yoon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1038 days.

(21) Appl. No.: 12/597,523

(22) PCT Filed: Apr. 25, 2008

(86) PCT No.: PCT/KR2008/002351

§ 371 (c)(1),
(2), (4) Date: Apr. 5, 2010

(87) PCT Pub. No.: WO2008/133444

PCT Pub. Date: Nov. 6, 2008

(65) Prior Publication Data

US 2010/0206016 A1 Aug. 19, 2010

(30) Foreign Application Priority Data

Apr. 25, 2007 (KR) ..... 10-2007-0040321
Jan. 3, 2008 (KR) ..... 10-2008-0000781

(51) Int. Cl.
*F26B 11/02* (2006.01)
*F26B 25/06* (2006.01)

(52) U.S. Cl.
USPC ..... 34/595; 34/603

(58) Field of Classification Search
USPC ..... 68/5 C, 5 R; 34/381, 108, 130, 132, 595, 34/596, 139
See application file for complete search history.

(56) References Cited

U.S. PATENT DOCUMENTS

| | | | | |
|---|---|---|---|---|
| 6,972,397 | B2 * | 12/2005 | Ha | 219/401 |
| 7,091,454 | B2 * | 8/2006 | Cho et al. | 219/401 |
| 2006/0117596 | A1 * | 6/2006 | Kim et al. | 34/607 |
| 2008/0000098 | A1 * | 1/2008 | Choi et al. | 34/114 |

FOREIGN PATENT DOCUMENTS

| | | | |
|---|---|---|---|
| EP | 0 277 337 | A2 | 8/1988 |
| EP | 1 192 888 | A1 | 4/2002 |
| EP | 1 441 060 | A1 | 7/2004 |
| EP | 1 616 516 | A2 | 1/2006 |
| EP | 1 666 655 | A2 | 6/2006 |
| EP | 1 734 170 | A1 | 12/2006 |
| KR | 20-1987-0015180 | U | 10/1987 |
| KR | 20-1997-0044445 | U | 7/1997 |
| KR | 10-0595181 | B1 | 6/2006 |

(Continued)

OTHER PUBLICATIONS

PCT International Search Report and Written Opinion dated Oct. 15, 2010 issued in Application No. PCT/KR2008/002351.
European Search Report dated May 25, 2011 issued in Application No. EP 08 75 3172.
Korean Decision to Grant a Patent dated Aug. 2, 2010 issued in Application No. 10-2008-000781.

(Continued)

*Primary Examiner* — Joseph L Perrin
(74) *Attorney, Agent, or Firm* — Ked & Associates, LLP

(57) ABSTRACT

The present invention relates to a steam laundry drier, and more specifically to a steam laundry dryer capable of removing or preventing crease or wrinkle occurring in cloth, etc. and capable of improving assembling efficiency by easily mounting a steam generator provided to remove the crease or the wrinkle and a water supply source supplying water to the steam generator in the inside of the steam laundry drier.

13 Claims, 6 Drawing Sheets

(56) References Cited

FOREIGN PATENT DOCUMENTS

| | | | |
|---|---|---|---|
| KR | 10-2008-0007845 | A | 1/2008 |
| KR | 10-2008-0007869 | A | 1/2008 |
| KR | 10-2008-0058539 | A | 6/2008 |
| WO | WO 2006/126803 | A2 | 11/2006 |

OTHER PUBLICATIONS

European Search Report dated Aug. 23, 2012 issued in Application No. 08 753 172.9.

Korean Office Action dated Mar. 21, 2008 for Application No. 10-2007-0040321.

* cited by examiner

Fig. 6]
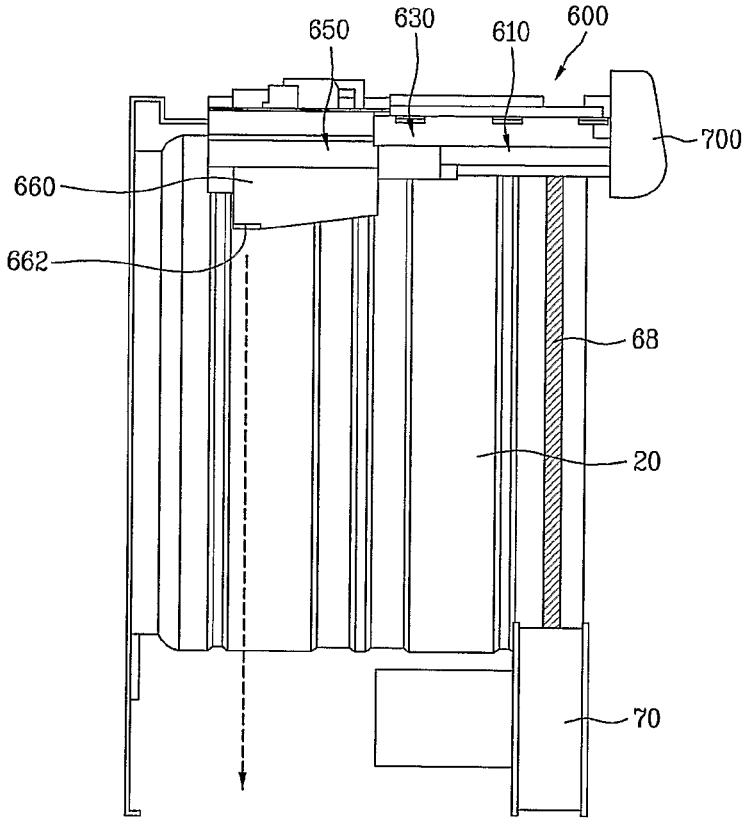
Fig. 7
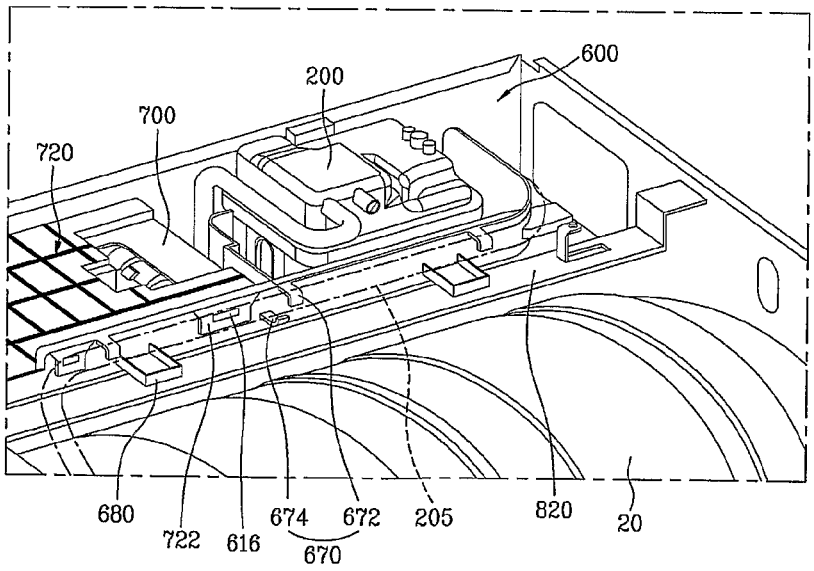

STEAM LAUNDRY DRYER

TECHNICAL FIELD

The present invention relates to a steam laundry dryer, and more specifically a steam laundry dryer capable of removing wrinkle of cloth at the time of drying and improving assembly.

BACKGROUND ART

A steam laundry dryer usually is a home appliance drying the laundry of which washing is completed, that is, cloth using a high-temperature air. Generally, the steam laundry dryer includes a drum receiving articles to be dried, a driving source driving the drum, a heating means heating air flowed into the inside of the drum, and a blower unit sucking or discharging the air of the inside of the drum.

The steam laundry dryer may be divided into an electrical steam laundry dryer and a gas steam laundry dryer depending on a type heating the air, that is, the heating mean. The electric steam laundry dryer heats the air using electrical resistance heat, and the air steam laundry dryer heats the air using heat generated by gas combustion. The steam laundry dryer may be also divided into a condensing steam laundry dryer and a ventilating steam laundry dryer. In the condensing steam laundry dryer, the air in a humid state due heat-exchange with the article to be dried in the drum is circulated without being discharged to the outside of the steam laundry dryer, and is heat-exchanged with an external air in a separately condenser to make condensing water and discharge it to the outside. In the ventilating steam laundry dryer, the air in a humid state due heat-exchange with the article to be dried in the drum is directly discharged to the outside of the steam laundry dryer. The steam laundry dryer may be also divided into a top loading type and a front loading type depending on a type throwing the article to be dried in the steam laundry dryer. In the top loading type, the article to be dried is thrown in a top of the steam laundry dryer, and in the front loading type, the article to be dried is thrown in a front of the steam laundry dryer.

And, in general, the laundry of which the washing is completed and dehydration is performed is thrown and dried in the steam laundry dryer. However, wrinkle (crease, wrinkle, biding, etc are generally referred to as the wrinkle below) is generated in the laundry of which water washing is completed in view of principle of the laundry, and the generated wrinkle is not completely removed in a drying process in the steam laundry dryer.

In order to remove such a wrinkle, a steam generator is included in the steam laundry dryer, making it possible to remove the wrinkle generated in the drying process through a method spraying a generated steam.

The steam generator is supplied with electricity and water from the outside to a water supply source to generate steam and supply it to the inside of the drum.

Therefore, an inside of a cabinet of the steam laundry dryer should be provided with the steam generator and the water supply source, etc.

Also, in the case of the drum steam laundry dryer in the front loading type, the steam generator and the water supply source are provided in a remaining space after mounting the drum in the inside of the cabinet with a limited size, and in the case of mounting the drum in the front loading type, they may be mounted in spaces of the right and the left edges of the top and the bottom.

Also, the steam generator and the water supply source are connected by a pipe. Since it is not preferable that length of the pipe is long, it is preferable that the steam generator and the water supply source are mounted closely to any one space of the spaces of the right and the left edges of the top and the bottom. As described above, the water supply source may be positioned at a front side in the case where it is constituted in a detachable cartridge him, and the steam generator will be positioned at a rear space thereof.

And, as the water supply source, waterworks of the outside may be connected. Since a large amount of water is not required in the case of the steam laundry dryer, not a washing machine, the steam laundry dryer should be able to be mounted in a site in which the waterworks does not exist. Therefore, the water supply source in the cartridge form may be also used.

As such, the water supply source and the steam generator should be mounted in the inside of the steam laundry dryer with a wrinkle removing function. After the drum is first mounted in the inside of the cabinet forming an outer appearance of the steam laundry dryer, the steam generator and the water supply source should be mounted in a narrow remaining space.

Since the drum is a device drying the cloth therein while rotating, it is exposed to a continuous vibration. Therefore, a need exists for a method for firmly mounting the steam generator and the water supply source in the inside of the cabinet.

Also, a need exists for a method capable of reducing fabricating time and cost by making mounting positions of each of the steam generator and the water supply source consistent to improve assembly of an engineer fabricating a product.

DISCLOSURE OF INVENTION

Technical Problem

A steam laundry dryer is a device drying the cloth therein while rotating, it is exposed to a continuous vibration. Therefore, a need exists for a method for firmly mounting the steam generator and the water supply source in the inside of the cabinet.

Also, a need exists for a method capable of reducing fabricating time and cost by making mounting positions of each of the steam generator and the water supply source consistent to improve assembly of an engineer fabricating a product.

Technical Solution

To achieve these objects and other advantages and in accordance with the purpose of the invention, as embodied and broadly described herein, a steam laundry drier including a drum rotatably mounted on a cabinet, a steam generator supplying steam to the drum, a water supply source supplying water to the steam generator and a supporting member supporting the water supply source and the steam generator in the inside of the cabinet.

Specifically, the water supply source is detachably mounted on a drawer that is insertibly and withdrawably mounted on one side of the cabinet, the insertion and withdrawal of the drawer being guided by the integrally formed supporting member.

Preferably, the supporting member includes a drawer guide part that guides the insertion and withdrawal of the drawer; and a steam generator fixing part that is extendedly formed from the drawer guide part to fix the steam generator.

Specifically, a pump that supplies water from the water supply source to the steam generator, the supporting member being further provided with a pump fixing part to which the pump is fixed, the drawer guide part being positioned at a front of the supporting member, the steam generator fixed part being positioned at a rear of the supporting member, and the pump fixing part being positioned between the drawer guide part and the steam generator fixing part.

Preferably, any one place between the pump fixing part and the drawer guide part or between the pump fixing part and the steam generator fixing part is provided with a rib transversing the supporting member.

Specifically, the rib is provided between the pump fixing part and the drawer guide part, the rib is provided with a through hole that can form a channel between the water supply source and the pump.

Preferably, the lowers of the drawer guide part, the pump fixing part, and the steam generator fixing part, respectively, are provided with concave receiving spaces that receives water leaked from connection parts with the pump when the water supply source is decoupled.

Specifically, the rib is provided with a connection hole so that the neighboring receiving spaces are communicated with each other.

Preferably, the connection hole formed at the rib provided between the pump fixing part and the drawer guide part is formed to be spaced by a predetermined distance from the base of the supporting member.

Specifically, any one of the receiving spaces provided at the lowers of the drawer guide part and the steam generator fixing part is inclined toward the rear.

Preferably, the rear of the receiving space provided at the lower of the steam generator fixing part is provided with a discharge hole that discharges collected water.

Specifically, a driver rotating the drum is disposed at the front of the cabinet and the steam generator fixing part of the supporting member is disposed at the rear of the cabinet so that the water discharged from the discharge hole is not splattered toward the driver that drives the drum.

Preferably, the supporting member is adjacently disposed at the cabinet so that the water discharged from the discharge hole flows down along a channel formed along the inner surface of the cabinet.

Preferably, the supporting member is constituted by a base and a side wall extendedly formed from the base, the supporting member further includes one or more the fixing member formed along the outside of the side wall and the fixing member fixes wirings connected to the steam generator so that the wirings do not contact the drum.

Specifically, the fixing member is constituted by an upper fixing member and a lower fixing member, the upper fixing member and the lower fixing member having a curved shape toward each other so that the wirings can be fixed in a space between the upper fixing member and the lower fixing member.

In another aspect of the present invention, A steam laundry drier includes a cabinet forming an outer appearance, a drum rotatably mounted in the cabinet, a steam generator supplying steam to the drum, a water supply source supplying water to the steam generator and a supporting means determining a position of the steam generator or the water supply source and fixing it to the determined position.

Preferably, the supporting means includes a groove or a hole into which a projection projectively formed on one side of at least one of the steam generator and the water supply source and a frame passing above the upper of the drum and a projection formed on the other side thereof can be inserted.

Specifically, the supporting means includes screw holes formed at the frame, the steam generator, and the water supply source and screws coupled with the screw holes to couple the frame with the steam generator and the water supply source, respectively.

Preferably, the water supply source includes a cartridge storing water, a drawer receiving the cartridge and performing advance and retreat movement in front and rear directions of the cabinet, and a drawer guide guiding and supporting the drawer and wherein the groove, the hole or the projection of the water supply source formed on one side of the drawer guide.

Specifically, the supporting means includes screw holes farmed at the frame, the steam generator, and the drawer guide and screws coupled with the screw holes to couple the frame with the steam generator and the drawer guide, respectively.

Advantageous Effects

The present invention relates to a steam laundry drier, and more specifically to a steam laundry dryer capable of removing or preventing crease or wrinkle occurring in cloth, etc. and capable of improving assembling efficiency by easily mounting a steam generator provided to remove the crease or the wrinkle and a water supply source supplying water to the steam generator in the inside of the steam laundry drier.

BRIEF DESCRIPTION OF THE DRAWINGS

FIG. 6 is a schematic side view showing a state where the supporting module shown in FIG. 3 is mounted in a cabinet.

FIG. 7 is a perspective view showing the state where the supporting module shown in FIG. 3 is mounted in the cabinet.

MODE FOR THE INVENTION

Hereinafter, preferred embodiments of the present invention will be described in detail with reference accompanying drawings.

Figure 1:
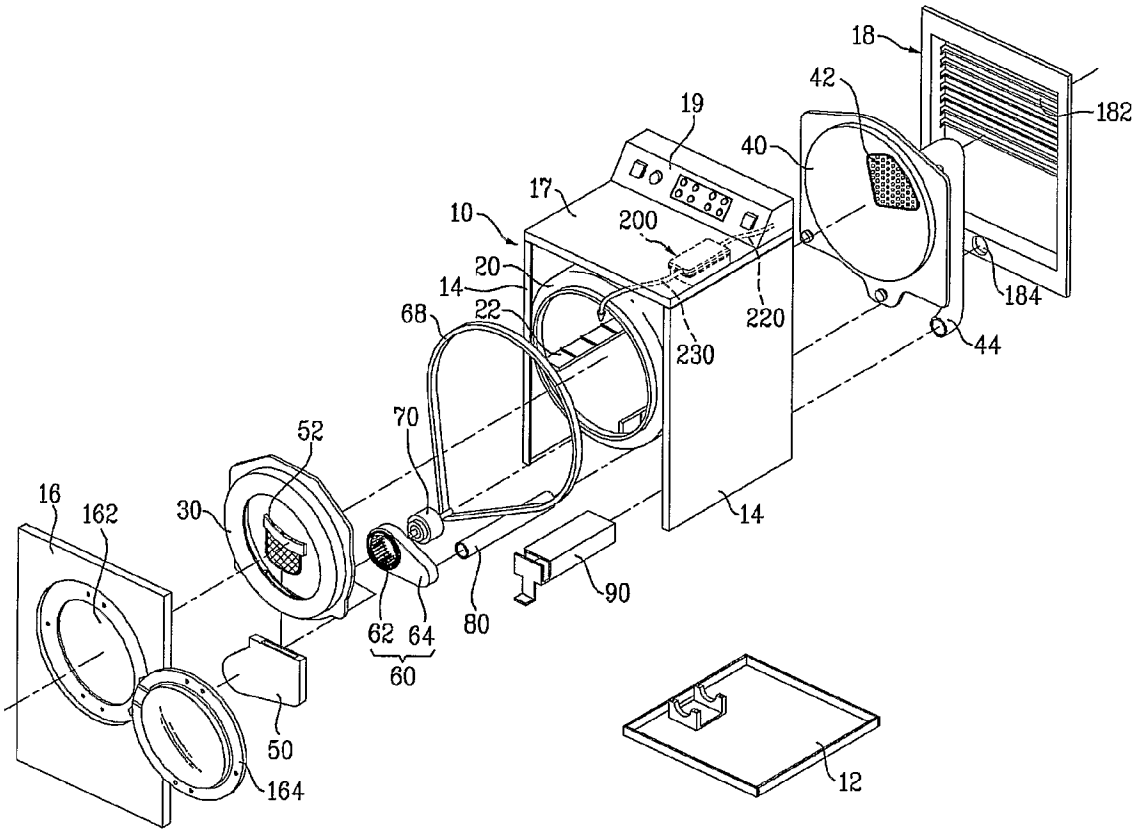
FIG. 1 is an exploded perspective view showing a configuration of a steam laundry dryer according to a preferred embodiment of the present invention.

FIG. 1 is an exploded perspective view showing a configuration of a steam laundry dryer according to a preferred embodiment of the present invention. One embodiment of the steam laundry dryer according to the present invention will be described with reference to FIG. 1.

A cabinet 10 forms an outer appearance of the steam laundry dryer according to the present invention, and the inside thereof is mounted with various components described below.

First, the inside of the cabinet 10 is mounted with a rotatably mounted drum 20, a motor 70 driving the drum 20, and a belt 68. And, a predetermined position of the cabinet 10 is mounted with a heater 90 (hereinafter, referred to as a hot blast heater far convenience) heating air to generate a high-temperature air (hereinafter, referred to as "hot blast") and a hot blast supply duct 44 supplying the hot blast generated from the hot blast heater 90 to the drum 20. And, a ventilation duct 80 discharging a humid air heat-exchanged with an article to be dried in the drum and a blower unit 60 sucking the humid air, etc. are also mounted therein. Meanwhile, a predetermined position of the cabinet 10 is mounted with a steam generator 200 generating a high-temperature steam.

Although an indirect drive type rotating the drum 20 using the motor 70 and the belt 68 is shown and illustrated for convenience of explanation in the present embodiment, the present invention is not limited thereto. That is, it is possible to apply the present invention to a direct drive type that the motor is directly connected to the rear surface of the drum 20 to directly rotate the drum 20.

Each of the components as described above will be described in detail.

The cabinet 10, which forms the outer appearance of the steam laundry dryer, includes a base 12 forming a bottom surface, a pair of side covers 14 mounted perpendicularly to the base 12, a front cover 16 and a rear cover 18 each mounted in the front surface and the rear surface of the side cover 14, and a top cover 17 positioned on the top of the side cover 14. A control panel 19 having various operating switches, etc. is usually positioned on the top cover 17 or the front cover 16, and a door 164 is mounted in the front cover 16. The rear cover 18 is provided with a suction part 182 allowing an external air to be flowed in, and a ventilation hole 184, which is a last passage discharging the air in the drum to the outside.

The inside space of the drum 20 functions as a drying chamber performing drying, and the inside of the drum 20 is preferably mounted with a lift 22 lifting the article to be dried and dropping it to reverse it, thereby raising drying efficiency.

Meanwhile, a front support 30 and a rear support 40 are mounted between the drum 20 and the cabinet 10, that is, between the drum 10 and 16 front cover 16 and between the drum 20 and the rear cover 18, respectively. The drum 20 is rotatably mounted between the front supporter 30 and the rear supporter 40, and sealing members (not shown) preventing leakage are mounted between the front support 30 and the drum 20 and between the rear supporter 40 and the drum 20, respectively. The front support 30 and the rear supporter 40 perform roles closing the front surface and the rear surface of the drum 20 to form the drying chamber and supporting the front end and the rear end of the drum 20.

The front supporter 30 is formed with an opening communicating the drum 20 to the outside of the stream laundry dryer, the opening being selectively opened and closed by a door 164. Also, a lint duct 50, which is a passage discharging the air in the drum 20 to the outside, is connected to the front support 30, and is mounted with a lint filter 52.

One side of a blower unit 60 is connected to the lint duct 50, and the other side of the blower unit 60 is connected to a ventilation duct 80. The ventilation duct 80 is in communication with the ventilation hole 184 provided in the rear cover 18.

Therefore, when the blower unit 60 operates, the air in the inside of the drum 20 is discharged to the outside through the lint duct 50, through the ventilation duct 80, and through the ventilation hole 184. In this case, foreign material such as nap, etc is filtered in the lint filter 52. Usually, the blower unit 60 is constituted by a blower 62 and a blower cabinet 64, and is generally driven by being connected to the motor 70 driving the drum 20.

The rear supporter 40 is usually formed with an opening 42 constituted by a plurality of holes, and the blast supply duct 44 is connected to the opening 42. The hot blast supply duct 44 performs a role of a passage in communication with the drum 20 and supplying the hot blast to the drum 20. Therefore, a predetermined position of the hot blast supply duct 44 is mounted with the hot blast heater 90.

Meanwhile, a predetermined position of the cabinet 10 is mounted with the steam generator 200 generating the steam to supply it to the inside of the drum 20. Hereinafter, the steam generator will be described in detail with reference to the drawings.

Figure 2:
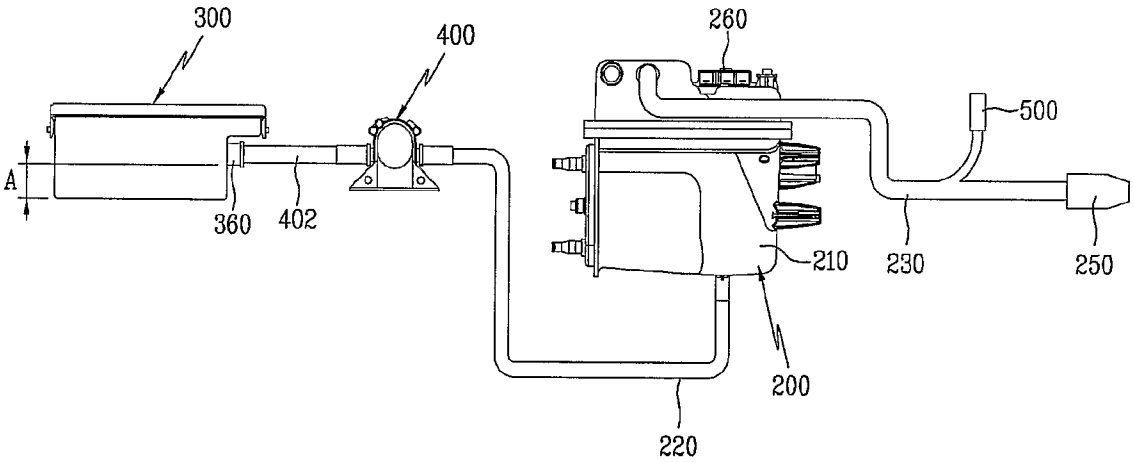
FIG. 2 is a schematic view showing a configuration of a cartridge supplying water and a steam generator according to one embodiment of the steam laundry dryer shown in FIG. 1.

FIG. 2 is a schematic view showing a steam generator according to a preferred embodiment of the present invention. The steam laundry dryer according to the present invention will be described with reference to FIG. 2.

The steam generator 200 includes a water tank 210 receiving water therein, a heater (not shown) mounted in the inside of the water tank 210, a water level sensor 260 measuring a water level of the steam generator 200, and a temperature sensor (not shown) measuring temperature of the steam generator 200. Although not shown, the water level sensor 260 is constituted by a common electrode, a low water level electrode, and a high water level electrode to sense a high water level and a low water level by whether conduction between the common electrode and the high water level electrode is generated or conduction between the common electrode and the low water level electrode is generated.

A water supplying hose 220 supplying the water is connected to one side of the steam generator 200, and a steam hose 230 discharging the steam is connected to the other side thereof. A tip of the steam hose 230 is preferably provided with a nozzle 250. Usually, one end of the water supplying hose 220 is connected to a water supply source such as a cartridge 300, and the tip or the nozzle 250 of the steam hose 230, that is, an steam outlet is positioned at a predetermined position of the drum 20 to spray the steam to the inside of the drum 20.

Meanwhile, while the water supply source may be made of the detachably mounted cartridge 300 as in the present embodiment, it may be also made of a faucet positioned at the outside. However, if the water supply source is made of the faucet, mounting thereof becomes complicated. The reason is that since the water is not usually used in the steam laundry dryer, in the case of using the faucet as the water supply source, various devices, etc. concomitant with this should be additionally mounted. Therefore, filling the water in a state decoupling the water supply source and connecting the water supply source 300 filled with the water to the a water supply channel, that is, the water supplying hose 220 of the steam generator 200 by using the detachable water supply source 300 as in the present embodiment is very convenient.

And, a pump 400 is preferably provided between the water supply source 300 and the steam generator 200. It is more preferable that the pump 400 may be rotated forwardly and backwardly to be able to supply the water to the steam generator 200 or retrieve remaining water in the steam generator 200 if needed. Herein, the reason for retrieving the remaining water in the steam generator 200 is that if the steam generator is not used for a long time, there is a risk that the heater is impaired due to the remaining water or rotten water is later used. Also, a steam channel, that is, the steam hose 230 discharging the steam from the steam generator 200 is provided with a safety valve 500.

Hereinafter, a configuration that the steam generator is mounted in the cabinet in the steam laundry dryer of the present invention will be described in detail with reference to reference to the drawings.

Figure 3:
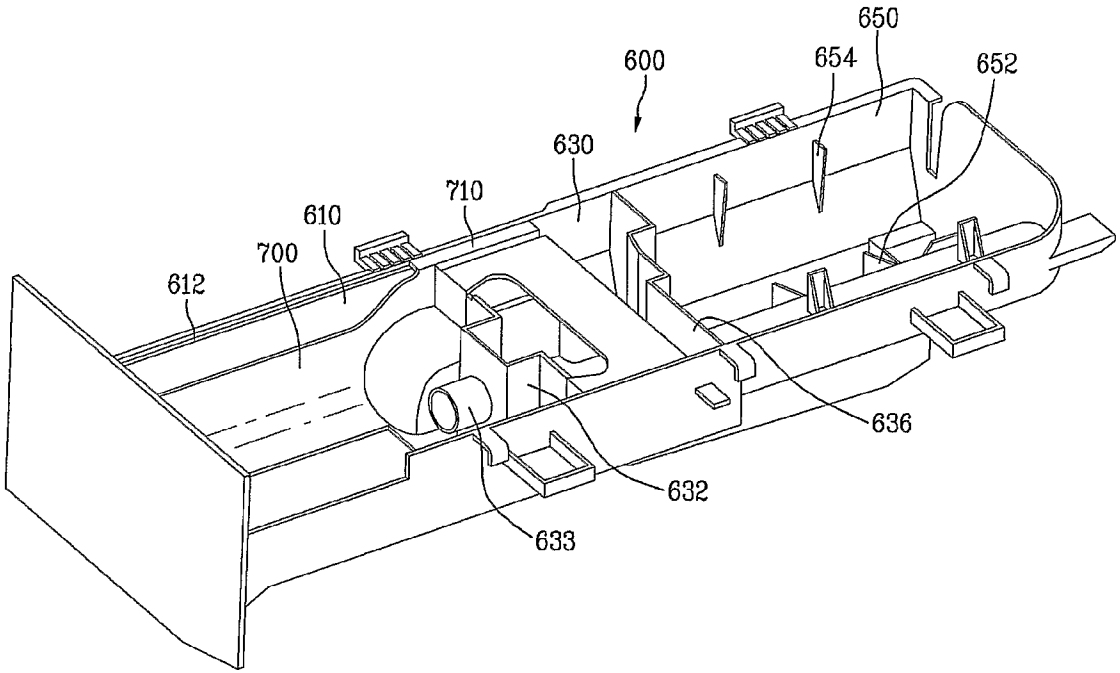
FIG. 3 is a perspective view showing a supporting module in the steam laundry dryer according to another preferred embodiment of the present invention.

FIG. 3 is a perspective view showing a supporting member mounted with the steam generator in the steam laundry dryer according to a preferred embodiment of the present invention.

Referring to FIG. 3, the steam laundry dryer according to the present invention includes a drawer 700 detachably mounted in the cabinet 10 (refer to FIG. 1), the drawer being selectively mounted with the cartridge 300. That is, it is preferable that the drawer 700 is insertibly and withdrawably mounted in the cabinet 10 and the cartridge 300 is mounted on the drawer 700, rather than direct mounting of the cartridge 300 in the cabinet 10.

Meanwhile, in the case of mounting the above-mentioned components in the steam laundry dryer, if the respective components are separately mounted in the steam laundry dryer, a fabrication process and time increases, thereby considerably lowering productivity and production efficiency.

And, in the case of a drum steam laundry dryer in a front loading, the drawer 700 mounted with the steam supply device and the water supply source, that is, the cartridge 300, etc. is mounted in a remaining space after mounting the drum in the inside of the cabinet with a limited size. In the case of mounting the drum in the front loading type, the drawer 700 may be mounted in spaces of the right and the left edges of the top and the bottom inside the cabinet.

Also, the steam supply device and the water supply source are connected by a pipe. Since it is not preferable that length of the pipe is long, it is preferable that the steam supply device and the water supply source are mounted closely to any one space of the spaces of the right and the left edges of the top and the bottom. As described above, it is advantageous to position the water supply source at a front side in the case where it is constituted in a detachable cartridge form, and the steam generator may be positioned at a rear space thereof.

And, as the water supply source, the waterworks of the outside may be connected. However, since a large amount of water is not required in the case of the steam laundry dryer, not the washing machine, the steam laundry dryer should be able to be mounted in a site in which the waterworks does not exist. Therefore, the water supply source in the cartridge form may be also used, as described above.

After the drum receiving cloth to be dried is first mounted in the inside of the cabinet forming an outer appearance of the steam laundry dryer, the steam generator and the water supply source should be mounted in a narrow remaining space. Therefore, in order to raise efficiency of assembly, a need exists for a method for more simply mounting the water supply source or the steam generator in the inside of the cabinet.

Hereinafter, embodiments capable of raising the efficiency in mounting the steam generator and the water supply source in the inside of the cabinet will be described.

FIG. 3 is a perspective view of the supporting member for mounting the steam generator and the water supply source of the steam laundry dryer according to the present invention therein. The supporting member 600 is a module supporting means for mounting the steam generator and the water supply source therein.

The steam laundry dryer according to the present invention includes the supporting member 600 guiding the movement of the drawer 700 in the case where the drawer 700 is inserted and withdrawn, and further supporting the steam generator 200 (refer to FIG. 2). The supporting member 600 is mounted in one side of the cabinet 10, preferably, the front of the cabinet 10, guides the movement of the drawer 700 as described above, and further supports the steam generator 200.

More specifically, the supporting member 600 has an approximately hexahedral shape with an opened upper, and is preferably integrally formed of one member. Since the supporting member is integrally formed, it is easy to fabricate it and is further convenient to assemble various components described below. Meanwhile, the supporting member 600 includes a drawer guide part 610 guiding the movement of the drawer 700, and a steam generator fixing part 630 supporting and fixing the steam generator 200.

As shown in FIG. 3, the drawer guide part 610 is formed at a front of the supporting member 600, so that is the drawer 700 may be inserted and withdrawn through the opened front. The drawer guide part 610 preferably has an internal shape corresponding to an appearance of the drawer 700 in order to be able to guide the movement of the drawer 700. For example, as shown in FIG. 3, in the case where the drawer 700 has an approximately hexahedral shape with an opened upper, the internal shape of the drawer guide part 610 preferably has an approximately hexahedral shape with an opened upper corresponding to the shape of the drawer.

Also, it is preferable that the inner surfaces of both sides of the drawer guide part 610 are formed with guide jaws, and the both sides of the drawer 700 are formed with projections 710, so that the projections 710 move along the guide jaws and the movement of the drawer 700 is guided.

Meanwhile, a steam generator fixing part 650 is formed at the rear of the supporting member 600, so that the steam generator 200 is seated and fixed thereto. More specifically, the lower of the steam generator fixing unit 650 is formed with a plurality of supporting rib 652 supporting the steam generator 200, and both side walls of the steam generator fixing part 650 is formed with a plurality of fixing rib 654. In this case, a distance between the fixing ribs 654 formed on both side wall of the steam generator fixing part 650 is preferably formed to correspond to a width of the steam generator 200. Therefore, in the case of seating the steam generator 200 to the steam generator fixing part 650, the lower of the steam generator 200 is supported by the supporting rib, and both sides of the steam generator 200 is fixed by the fixing rib 654.

Also, although not shown in the drawings, the steam generator 200 is preferably firmly fixed to the steam generator fixing part 650 by a coupling member, etc. such as a bolt. The coupling member is coupled to the steam generator 200 through the lower or the side of the steam generator fixing part 650, to be able to fix the steam generator 200.

As such, in the case where the cartridge 300 is mounted on the drawer 700 so that it is inserted and withdrawn along the drawer guide part 610 and the steam generator 200 is seated and fixed to the steam generator fixing part 650, the pump 400 is preferably provided between the cartridge 300 and the steam generator 300 as described above.

The pump 400 is preferably fixed to a pump fixing part 630 formed between the drawer guide part 610 and the steam generator fixing part 650.

More specifically, the pump fixing part 630 is formed between the drawer guide part 610 and the steam generator fixing part 650, wherein the pump fixing part is partitioned by fouling a first rib 632 between the drawer guide part 610 and the pump fixing part 630 and fouling a second rib 636 between the pump fixing part 630 and the steam generator fixing part 650.

The pump 400 is fixed to the pump fixing part 630, and is connected to the cartridge 300 through a through hole 633 formed in the first rib 632. That is, in the case of mounting the cartridge 300 on the drawer 700 and pushing the drawer 700, the drawer 700 moves along the drawer guide part 610. When the draw 700 moves so that the end of the drawer 700 contacts the first rib 632 formed at the rear of the drawer guide part 610, the cartridge 300 mounted on the drawer 700 is connected to the pump 400 through the through hole 633. Therefore, the water in the cartridge 300 is supplied to the steam generator 200 by the driving of the pump 400. Also, the whole water in the cartridge 300 is supplied to the steam generator 300, or in the case of exchanging the water in the cartridge 300 with a clean water, a user draws the drawer 700 and decouples the cartridge 300 to supply the water thereto.

Meanwhile, the first and second ribs 632 and 636 are brined to traverse the supporting member 600, and perform a role of partitioning the drawer guide part 610, the pump fixing part 630 and the steam generator fixing part 650 as described above, a role of reinforcing strength of the supporting member 600, as well as a role of preventing exposure in order that various electric field articles mounted in the supporting member 600 is not visible from the outside.

That is, various components such as the pump 400, the steam generator 200 and various wirings connecting them are placed in the supporting member 600. Without the first and second ribs 632 and 636, when the drawer 700 is drawn, the various components and wirings are visible from the outside. This is not preferable in view of appearance, as well as when failure, etc. occurs in the various components and wirings, there is a risk of a wound of the user.

Therefore, the steam laundry dryer of the present invention includes the first and second ribs 632 and 636 in the supporting member 600 so that the various components and wirings positioned in the supporting member 600 is not visible from the outside. In this case, it is possible to mount only the first rib 632. However, it is preferable that the second rib 636 is further included at the rear of the first rib 632 to doubly prevent the exposure.

Meanwhile, when drawing the drawer 700 and decoupling the cartridge 300 from the pump 400 in order to exchange the water in the cartridge 300, a small amount of water remaining in the inside of the hose connecting the pump 400 and the connection part 360 (refer to FIG. 2) of the hose 402 (refer to FIG. 2) may be leaked. When the small amount of water is leaked, it may be naturally dried and evaporated in the inside of the supporting member 600. However, when a large amount of water is leaked from the cartridge 300 or the steam generator 200 due to damage of the cartridge 300 or the steam generator 200, it is difficult to evaporate the water by natural drying. Also, the large amount of leaked water has an effect on the driving of the pump, and further short-circuits the steam generator 200 to damage it. Therefore, the supporting member 600 of the present embodiment preferably a water collecting mean capable collecting the leaked water as described above and discharging it.

Hereinafter, the water collecting mean will be described in detail with reference to FIG. 4.

Figure 4:
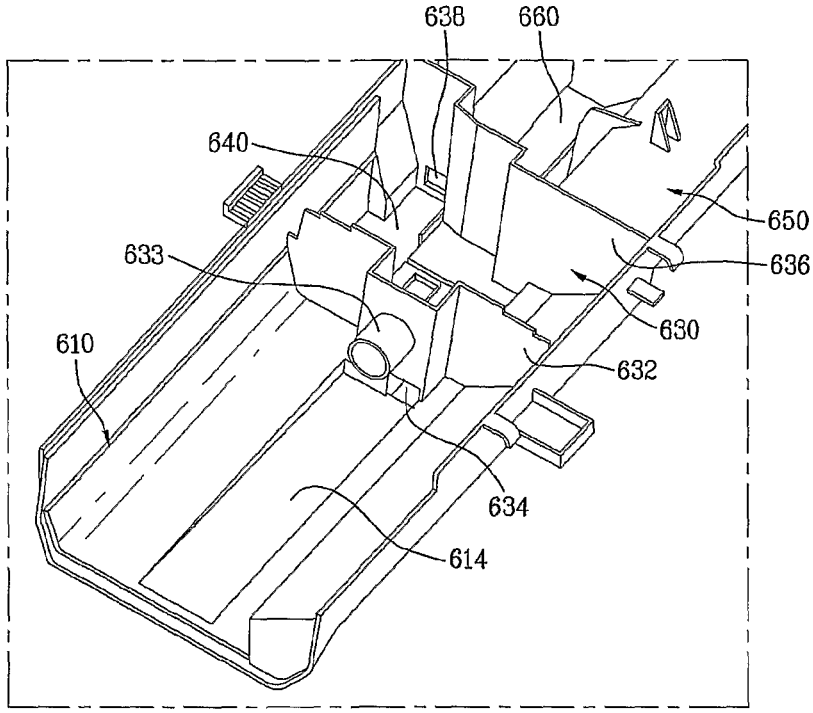
FIG. 4 a partial perspective view showing a drawer guide part in the supporting module shown in FIG. 3.

FIG. 4 is a perspective view showing the supporting member according to one embodiment of the present invention.

Referring to FIG. 4, the water collecting means may be constituted by a first receiving space 614, a second receiving space 640, a third receiving space 660, and a discharge hole 662 (refer to FIG. 6) firmed along the lower of the supporting member 600. Hereinafter, they will be described in detail with reference to FIG. 4.

First, the first receiving space 614 may be formed at a predetermined depth long the lower of the drawer guide part 610. In this case, the first receiving space 614 is preferably formed to be extended along the lower of the through hole 633 formed in the first rib 632. The reason is that the hose 492 (refer to FIG. 2) connected to the pump 400 is connected to the connection part 360 of the cartridge 300 through the through hole 633 so that when decoupling the cartridge 300, the water is leak from the hose 402 approximately parallelly extended from the through hole 633.

Meanwhile, the first receiving space 614 is preferably formed to be downwardly inclined at a predetermined angel, for example, an angle of 1 to 2 toward the rear of the drawer guide part 610. That is, since the first receiving space 614 is formed in an a form downwardly inclined toward the rear, the water collected in the first receiving space 614 due to leakage flows along the inclination of the first receiving space 614 is filled from the rear. Therefore, even when the user draws the drawer 700, the water positioned at the rear of the first receiving space 614 is not visible to be excellent in view of appearance.

Also, the first receiving space 614 is preferably formed to be in communication with the second receiving space 640 formed at the lower of the pump fixing part 630. In the present embodiment, the first receiving space 614 and the second receiving space 640 is communicated to each other by a first connection hole 634 formed in the first rib 632. In this case, the first connection hole 634 is formed to contact the bottom of the supporting member 600, to communicate the first and second receiving spaces 614 and 640 to each other. Therefore, the water leaked from the hose 402 of the pump 400 flows to the rear along the inclination of the first receiving space 614, and is collected in the second receiving space 640 of the pump fixing part 630 through the first connection hole 643. Accordingly, although the user draws the drawer 700, the second receiving space 640 of the pump fixing part 630 is not visible by the first rib 632. Therefore, the leaked water is not visible to the user to be excellent in view of appearance.

Figure 5:
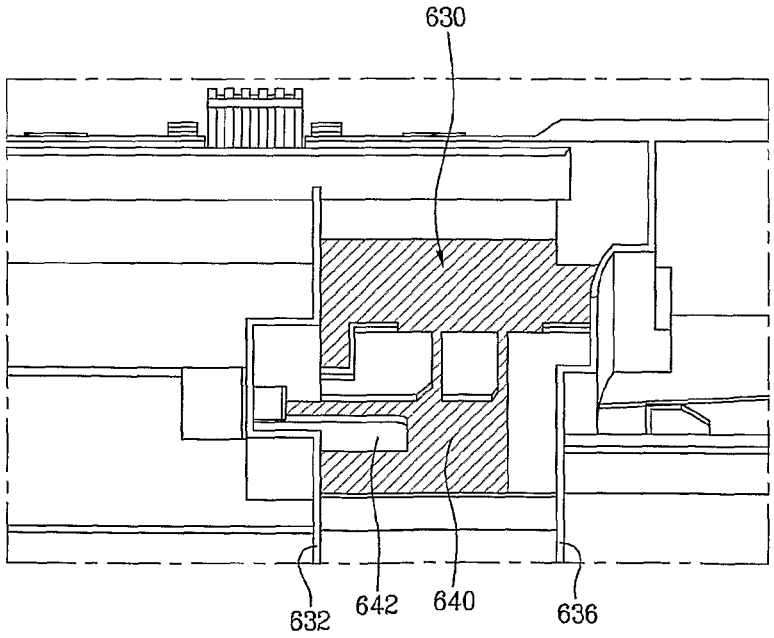
FIG. 5 is a partial perspective view showing a pump fixing part shown in FIG. 3.

The pump fixing part 630 formed with the second receiving space 640 as above is shown in detail in FIG. 5.

Referring to FIG. 5, the second receiving space 640 is formed along the lower of the pump fixing part 630 between the first and second ribs 632 and 636. The second receiving space 640 is shown as oblique lines for easy of identification. Of course, such a second receiving space 640 is not limited in a shape, and may be suitably modified to have a variety of shapes.

Turning back to FIG. 4, the steam generator fixing part 650 is formed with a third receiving space 660, and the second rib 636 forming a boundary of the third receiving space 660 and the second receiving space 640 is formed with a second connection hole 638 selectively communicating the third receiving space 660 and the second receiving space 640. That is, the second connection hole 638 is preferably formed spaced by a predetermined interval, for example, an interval of 1 to 2 mm from the bottom of the supporting member 600, as shown in FIG. 4. This is to naturally dry the water in the second receiving space 640 when the water below a predetermined amount is flowed into the second receiving space 640 and overflow the water to the third receiving space and discharge the water through the discharge hole 662 of the third receiving space 660 described below when the water above a predetermined amount is flowed into the second receiving space 640.

More specifically, when the water below a predetermined amount, that is, below a height of the second connection hole 638 is flowed into the second receiving space 640, it is judged that it has a slight effect on the various components and wirings, so that the water is naturally dried in the second receiving space 640 without being fib wed into the third receiving space 660. Meanwhile, when a large amount of water is flowed into the second receiving space 640 due to the damage of the cartridge 300 or the steam generator 200 etc., that is, when the water above a predetermined height of the second connection hole 638 is flowed therein, it is judged that the damage of the various components may be caused, so that the water is flowed into the third receiving space 660 through the second connection hole 638, thereby discharging the water to the outside through the discharge hole 662 of the third receiving space 660.

So, if inclined receiving spaces are provided at the lower part of the supporting member 600, the space where the water overflows and the space where evaporates and drains can be separated.

The third receiving space 660 and the discharge hole are shown in detail in FIG. 6.

FIG. 6 is a configuration view schematically showing a state where the supporting member 600 is mounted in the cabinet 10.

Referring to FIG. 6, the third receiving space 660 is preferably formed to be downwardly inclined at a predetermined angle toward the rear, and is formed with the discharge hole 662 discharging the collected water in the rearmost thereof to the outside.

That is, as described above, the water flowed from the second receiving space 640 into the third receiving space 660 through the second connection hole 638 is flowed to the rear along the inclination of the third receiving space 660, and is discharged along the discharge hole 662 formed at the rear of the third receiving space 660 to the outside of the supporting member.

Meanwhile, the water discharged from the supporting member 600 as described above drops toward the upper of the bottom of the cabinet 10. When the water drops toward the drum 20, the water spatters and spreads to the inside of the steam laundry dryer in the case where the drum rotates. Also, when the dropped water spatters in the bottom so that it is thrown in the inside of the motor 70 driving the drum 20, the motor is short-circuited so that the motor may be damaged.

Therefore, in the present embodiment, it is preferable that the motor 70 rotating the drum 20 is positioned at the lower of the front of the cabinet 10, and the steam generator fixing part 650 of the supporting member 600 is positioned at the rear of the upper of the cabinet 10. Further, the discharge hole 662 is preferably positioned at a side opposite to the drum 20. Thereby, as shown in FIG. 6, the water dropped through the discharge hole 662 does not drop to the drum 20 and becomes maximally away from the motor 70 to prevent that the dropped water spatters to be thrown in the motor 70. Although not shown in the drawing, the motor 70 of the present embodiment may be provided with a motor cover (not shown) covering an appearance of the motor 70. Since the motor cover is mounted to cover the appearance of the motor 70, it is possible to prevent the water dropped from the discharge hole 662 from being thrown in the inside of the motor 70.

Also, although the cabinet is not shown in FIG. 6, in the supporting member 600, the discharge hole 662 may be displaced to be adjacent to the inner surface of the cabinet 10. When the discharge hole 662 is displaced to be very adjacent to the inner surface of the cabinet 10, the water discharged from the discharge hole 662 does not directly drop, and can form a predetermined channel along the inner surface of the cabinet 10 and flow therethrough. Therefore, the water discharged from the discharge hole 662 directly drops so that it cannot spatter in the bottom.

Meanwhile, the drawer 700 mounted with the cartridge 300 moves along the drawer guide part 610 of the supporting member 600 as described above. In this case, as described in FIG. 3, the projection 710 on both sides of the drawer 700 moves along the guide jaw 612 formed on both inner surfaces of the drawer guide part 610 so that the movement of the drawer 700 is guided. However, when the drawer 700 moves as described above, as the drawer 700 is withdrawn to the outside of the cabinet 10, the supported part becomes small so that the rear of the drawer 700 may be lifted and the front thereof be downwardly sunk.

Therefore, in the present embodiment, as shown in FIG. 7, a drawer guide cover 720 is provided on the upper of the drawer guide part 610 so that although the drawer 700 is withdrawn, the rear of the drawer 700 is supported not to be lifted.

In this case, it is preferable that the drawer guide cover 720 is detachably mounted on the upper of the drawer guide part 610. For example, as shown in FIG. 7, one or more locker 722 is formed along the both sides of the drawer guide cover 720. The locker 722 may be locked and fixed to a locking jaw 616 formed on the upper of the drawer guide part 610.

Meanwhile, various wirings transmitting/receiving electric signals from a controller (not shown) supplying power are connected to the steam generator 200 and the pump 400, etc. mounted in the supporting member 600 according to the present embodiment. In the prior scheme, these wirings have been fixed to a supporter 820 shown in FIG. 7 using a cable tie, etc. However, such a scheme fixing the wiring using the cable tie involves a problem that since it should individually fix the wirings to the supporter 820 using the cable tie, much time is consumed so that the overall assembly efficiency of the steam laundry dryer is considerably lowered. Also, in the conventional scheme, there is a risk that the wirings continuously contact the support 820 due to vibration generated during the driving of the steam laundry dryer to cause damage and short-circuit.

Therefore, in the present embodiment, a fixing member 670 supporting the various wirings 205 connected to the steam generator 200 and the pump 400 not to allow them to be sunk is provided. Herein, it is preferable that one or more fixing member 670 is formed along the outer side of the supporting member 600.

Referring to FIG. 7, the fixing member 670 is constituted by an upper fixing member 672 and a lower fixing member 674 in order to be able to fix the wiring 205. As shown in FIG. 7, the upper fixing member 672 and the lower fixing member 674 are curved facing each other so that space capable of receiving the wiring 205 is formed between the upper fixing member 672 and the lower fixing member 674. Also, the upper fixing member 672 and the lower fixing member 674 are preferably made of flexible materials.

Meanwhile, in the present embodiment, while the upper fixing member 672 and the lower fixing member 674 may be formed along a straight line, they may be formed to be crossed to each other.

In the case where the upper fixing member 672 and the lower fixing member 674 are formed along the straight line, in order to fix the wiring 205, the wiring 205 is pushed between the upper fixing member 672 and the lower fixing member 674. Thereby, the upper fixing member 672 and the lower fixing member 674 are more or less curved so that the wiring 205 is received and fixed into the space between the upper fixing member 672 and the lower fixing member 674.

Also, in the case where the upper fixing member 672 and the lower fixing member 674 are formed to be crossed to each other, it is possible to more easily fix the wiring 205. That is, when the upper fixing member 672 and the lower fixing member 674 are disposed to be crossed to each other, it is possible to fix the wiring 205 without applying force to the wiring 205.

Meanwhile, the fixing member 670 can include only the upper fixing member 672. The reason is that a fixing bracket 680 formed along the outer side of the supporting member 600 substitutes for a role of the lower fixing member 600. That is, the fixing bracket 680 is projectedly formed along the outer side of the supporting member 600 to be connected to the supporter 820, thereby performing a role fixing the supporting member 600. When the upper fixing member 672 is formed on the upper of the fixing bracket 680 to be adjacent to this fixing bracket 680, the wiring is disposed along the space between the upper fixing member 672 and the fixing bracket 680. Therefore, the wiring is seated on the upper of the fixing bracket 680 so that the fixing bracket 680 substitutes for the role of the lower fixing member 600, thereby making it possible to reduce material cost.

Hereinafter, driving of the steam laundry dryer having a configuration as above will be schematically described.

first, before driving the steam laundry dryer, the user decouples the cartridge 300 from the cabinet 10, fills the cartridge with the water, and mounts the cartridge 300 in the cabinet 10.

Thereafter, when the steam laundry dryer is driven to supply the steam, the water is supplied from the cartridge 300 to the steam generator 200 by the driving of the pump 400, and the water is heated in the steam generator 200 so that the steam is supplied to the inside of the drum 20.

Meanwhile, although the case where the cartridge 300 farming the water supply source is detachably mounted in the cabinet 10 is mainly illustrated in the embodiment of the present invention, the present invention is not limited thereto and is applicable to the case where the water supply source is fixedly mounted.

When using the modular supporting member 600, it is possible to easily mount the steam generator and the water support source in a narrow space of the inside of the cabinet. Therefore, it is possible to improve efficiency of assembly.

Figure 8:
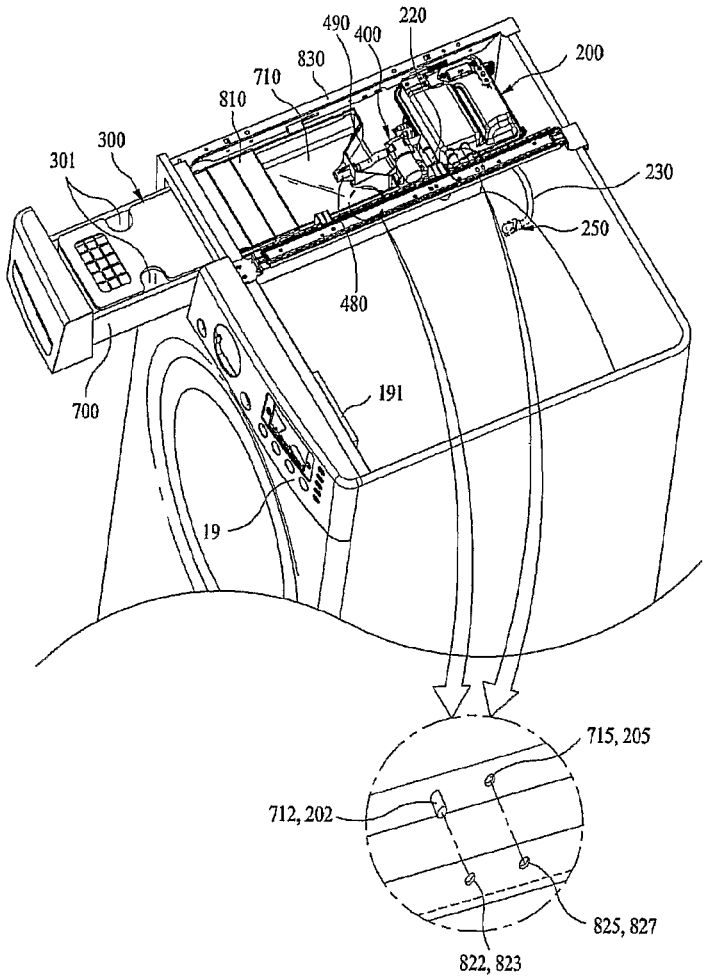
FIG. 8 is a view showing another embodiment in which a steam generator and a water supply source are mounted in the steam laundry dryer according to the present invention.

FIG. 8 shows another embodiment in which a steam generator and a water supply source are mounted in the steam laundry dryer according to the present invention. In the embodiment shown in FIG. 8, the steam generator and the water supply source are not mounted in the modular supporting member, but are directly mounted in the inside of the cabinet by a separate supporting means.

When using the modular supporting member, assembly may be more simply. However, it can have problems such as the cost of the supporting member or space shortage in the inside of the cabinet, etc. Therefore, a need exists for a method for mounting the steam generator and the water supply source in the inside of the cabinet without requiring a separate supporting member.

When not using the modular supporting member, mounting the steam generator and the water supply source in the inside of the cabinet can have a large speed difference depending on a skill degree of an assembler and not same mounting positions so that it is impossible to ensure completed qualities of uniform products. Therefore, a need exists for a method determining an accurate position of the steam generator and the water supply source and a method firmly fixing them at the determined position. Accordingly, in the embodiment of the steam generating device according to the present invention, a new supporting means for positioning and fixing the steam generator and the water supply source at an accurate position is used.

A steam laundry dryer shown in FIG. 8 also has an insertable and withdrawable drawer-type container 700 (hereinafter, referred to as a drawer) mounted in a pre-determined position, the drawer 700 being mounted with the cartridge 300.

That is, it is preferable that the cartridge 300 is mounted in the drawer 700 and the drawer 700 is inserted and withdrawn, thereby indirectly coupling/decoupling the cartridge 300 to/from the connector 480, rather than direct connection of the cartridge 300 to a connector 480.

The supporter 820 is mounted in the rear of the control panel 19. That is, the supporter 820 is mounted approximately in parallel with a top frame 830. It is preferable that a drawer guide 710 guiding and supporting the drawer 700 is mounted on the supporter 820 and the top frame 830, and it is more preferable that a top guide 810 is provided on a part of the upper of the drawer guide 710.

The supporter 820 and the top frame 830 serves as the frame of the steam laundry dryer and at the same time, may be used as a mounting place on which the water supply source and the steam supply device, etc may be mounted.

The drawer 700 may be provided on the front surface, for example, near the control panel 19.

In the embodiment shown in FIG. 8, in the case of mounting the cartridge 300 on the drawer 700, it is preferable that at least both side shapes of the cartridge 300 correspond to the both side shapes of the drawer 700 so that they are closely coupled to each other. And, it is preferable that recesses 301 are formed at both sides of the cartridge 30 for detachment of the cartridge 300, to detach the cartridge 300 using the recess 301.

A scheme supplying the water to the cartridge 300 will be described.

The steam laundry dryer according to the present invention supplies the hot blast or the steam while rotating the inner drum, thereby drying the cloth and removing the wrinkle. Therefore, the steam laundry dryer is continuously vibrated by a continuous vibration.

Also, the water supply source and the steam generator are disposed at an accurate position in an assembly process. When they are mounted away from a position intended at the time of product design, an unexpected defect, etc. occurs. Therefore, it is necessary to mount them at an accurate position.

In addition, after determining the accurate position, a supporting means for fixing them to the determined position is required.

In the embodiment shown in FIG. 8, the water supply source is provided in a detachable cartridge form. Therefore, the frame supporting the water supply source does not directly support the detachable cartridge 300, but supports the drawer guide 700 supporting and guiding the drawer 700 receiving the cartridge 300.

Also, in the same manner as that the supporter supports the drawer guide 710, the supporter also supports the steam generator 200.

The frames supporting the water supply source (drawer guide) and the steam generator 200 are the top frame 830 provided at the inner edge of the housing and the supporter 820, etc. provided at the rear of the control panel 19.

As described above, since the steam laundry dryer in the front loading type is used and the detachable water supply source, rather than waterworks pipe connection is used, the inside remaining space of an hexahedral housing is the remaining space of the upper and lower edges except for the space occupied by the drawing, and it is convenient to mount the drawer mounted with the cartridge 300 on the upper, as compared to the lower. Since it is not preferable that the length of the pipe connecting the water supply source and the steam generator 200 is long, it is preferable to arrange the steam generator 200 in line with the drawer guide at the rear surface of the drawer guide 710.

Also, a method reducing the number of provided frames for reinforcing strength of the housing or mounting the various components is to share the same frame. Therefore, mounting the water supply source and the steam generator 200 on the same frame can result in cost reduction effect.

The steam laundry dryer according to the present invention is constituted by a groove or a hole capable of being inserted with a projection projectively formed on one side of at least one of the steam generator 200 and the water supply source and the frame passing above the upper of the drum and a projection formed on the other side thereof as a means determining accurate mounting positions of the top frame 830 or the supporter 820 the water supply source and the steam generator 200.

That is, the groove capable of being inserted with the projection projectively formed on one side and the projection formed on the other side may be provided in both of the water supply source and the steam generator 200, and may be also provided only in any one of them.

The groove or the hole may be inserted with the projection formed on one side the projection formed on the other side in order to determine the accurate position.

When the part on which the projection will be formed is determined, the groove or the hole capable of being inserted with the projection is formed on the other side, so that it is possible to determine the position by inserting the projection into the groove or the hole at the time of product assembly.

In the embodiment of the present invention shown in FIG. 8, the groove or the hole capable of being inserted with the projection is provided in the frame such as the supporter, etc. And, the projection inserted into the hole is formed on a coupling part of the water supply source and the steam generator 200.

Also, since the cartridge 300 is detachable, the projection is formed on the drawer guide 710 guiding the drawer 700 in which the cartridge 300 is received.

With a partial enlarging view shown in FIG. 8, a first projection 712 and the second projection 202 are formed on the side of the drawer guide 710 and the side of the steam generator 200, respectively, the hole or the groove corresponding to the first and second projections 712 and 202 is formed on the side of the supporter 820.

In the embodiment shown in FIG. 8, the projections 712 and 202 are inserted into first and second holes 822 and 823 formed in the supporter. Since the first projection and the second projection are inserted into the first projection and the second projection, respectively, it is possible to accurately judge the mounting positions of the drawer guide 710 and the steam generator 200, respectively.

Also, although a method determining these positions of the drawer guide 710 and the steam generator 200 is described with respect to the supporter 820, it is obvious that it may be applied with respect to the supporter 820 as well as the top frame 810.

In addition, although the hole and the projection included in the supporting means are provided in both of the drawer guide 710 and the steam generator 200 in the embodiment shown in FIG. 8, they may be formed only in any one of them.

And, the steam laundry dryer requires a method determining the accurate mounting position as well as fixing the determined position.

In order to accurately determine the position by the groove capable of being inserted with the projection projectively formed on one side and the projection formed on the other side, and then, fix the steam generator and the water supply source without confirming that they are positioned at the accurate place, it is preferable that the projection and the groove or the hole corresponding thereto premise.

In order to fix the steam generator and the water supply source to the determined position, screw holes 715 and 205 are formed in the drawer guide 710, the steam generator 200 and screw holes 825 and 827 are formed in the supporter and then, the corresponding screw holes 715 and 825 and 205 and 827 are coupled using a separate screw, etc.

Therefore, in the embodiment shown in FIG. 8, the supporting means may be firmly fixed to the accurate position by the projection for determining the position, the groove or the hole inserted with the projection and determining the position, and the screw hole and screw formed in each of them in order to fix the steam generator and the water supply source to the determined position, and make work speed rapid.

Although this specification have been described with reference to the preferred embodiments of the present invention, those skilled in the art can variously modify and change the present invention without departing from the idea and scope of the present invention described in following claims. Therefore, if the modified embodiment basically includes components of claims of the present invention, it should be intended to be included in a technical scope of the present invention.

The invention claimed is:

1. A steam laundry drier including:

a drum rotatably mounted within a cabinet;

a steam generator supplying steam to the drum;

a water supply source supplying water to the steam generator; and a support member that supports the water supply source and the steam generator inside the cabinet, the support member having a unitary construction of a single member, wherein the water supply source is detachably mounted on a drawer that is insertibly and withdrawably mounted on one side of the cabinet, wherein the support member includes a drawer guide part that guides the insertion and withdrawal of the drawer; and a steam generator fixing part that extends from the drawer guide part to fix the steam generator.

2. The steam laundry drier according to claim 1, further including a pump that supplies water from the water supply source to the steam generator, the support member being further provided with a pump fixing part to which the pump is fixed, the drawer guide part being positioned at a front of the support member, the steam generator fixed part being positioned at a rear of the supporting member, and the pump fixing part being positioned between the drawer guide part and the steam generator fixing part.

3. The steam laundry drier according to claim 2, wherein a rib is provided either between the pump fixing part and the drawer guide part or between the pump fixing part and the steam generator fixing part, the rib transversing the support member.

4. The steam laundry drier according to claim 3, wherein when the rib is provided between the pump fixing part and the drawer guide part, the rib is provided with a through hole that can form a channel between the water supply source and the pump.

5. The steam laundry drier according to claim 4, wherein a lower portion of the drawer guide part, the pump fixing part, and the steam generator fixing part, respectively, are provided with concave receiving spaces that receive water which leaks from connection parts with the pump when the water supply source is decoupled.

6. The steam laundry drier according to claim 5, wherein the rib is provided with a connection hole so that neighboring receiving spaces are in communication with each other.

7. The steam laundry drier according to claim 6, wherein when the rib is provided between the pump fixing part and the drawer guide part, the through hole is formed to be spaced by a predetermined distance from a base of the support member.

8. The steam laundry drier according to claim 7, wherein any one of the receiving spaces provided at the lower portion of the drawer guide part and the steam generator fixing part is rearwardly inclined.

9. The steam laundry drier according to claim 8, wherein a rear of the receiving space provided at the lower portion of the steam generator fixing part is provided with a discharge hole that discharges collected water.

10. The steam laundry drier according to claim 9, a driver that rotates the drum is disposed at a front of the cabinet and the steam generator fixing part of the support member is disposed at a rear of the cabinet so that the water discharged from the discharge hole is not splattered toward the driver that drives the drum.

11. The steam laundry drier according to claim 10, wherein the support member is adjacently disposed to the cabinet so that the water discharged from the discharge hole flows down along a channel formed along an inner surface of the cabinet.

12. The steam laundry drier according to claim 11, wherein the support member comprises a base and a side wall that extends from the base, the support member further includes one or more fixing members formed along an outside of the side wall and the one or more the fixing members fixes wirings connected to the steam generator such that the wirings do not contact the drum.

13. The steam laundry drier according to claim 12, wherein the one or more fixing members comprise an upper fixing member and a lower fixing member, the upper fixing member and the lower fixing member having a curved shape toward each other such that the wirings can be fixed in a space between the upper fixing member and the lower fixing member.

* * * * *